United States Patent [19]

Linke et al.

[11] 4,216,450

[45] Aug. 5, 1980

[54] MILLIMETER WAVEGUIDE SHORTS

[75] Inventors: Richard A. Linke; Martin V. Schneider, both of Holmdel, N.J.

[73] Assignee: Bell Telephone Laboratories, Incorporated, Murray Hill, N.J.

[21] Appl. No.: 956,481

[22] Filed: Nov. 1, 1978

[51] Int. Cl.[2] ..... H01P 1/28; H01P 1/24

[52] U.S. Cl. ..... 333/248; 29/600; 333/253; 333/263

[58] Field of Search ..... 333/248, 253, 207–209, 333/156, 157, 159, 81 B, 160, 161, 263, 32–35, 231, 232, 233, 234; 29/600, 601, 527.2

[56] References Cited

U.S. PATENT DOCUMENTS

| | | | |
|---|---|---|---|
| 2,510,016 | 5/1950 | Fernsler | 333/81 B |
| 2,829,352 | 4/1958 | Hennies et al. | 333/253 X |
| 2,944,234 | 7/1960 | Ronde | 333/253 |
| 2,981,907 | 4/1961 | Bundy | 333/248 X |
| 3,049,684 | 8/1962 | Vaccaro et al. | 333/253 |

OTHER PUBLICATIONS

"Sliding Short Eases Measurements" (Anonymous) in Microwave, vol. 9, Dec. 1970; p. 26.

Larsen et al. "A Broadband Noncontacting Sliding Short" in NBS Technical Note 602, Jun. 1971; 18 pp.

Yates et al.—"Millimeter Attenuation and Reflection Coefficient Measurement System", NBS Technical Note 619, Jul. 1972; pp. 9–13, 74–75.

*Primary Examiner*—Marvin L. Nussbaum

*Attorney, Agent, or Firm*—Erwin W. Pfeifle

[57] ABSTRACT

The present invention relates to millimeter waveguide shorts and methods for making said shorts wherein an exemplary rectangular cross-sectioned waveguide short comprises a base substrate such as steel shimstock or foil having a width equal to the associated millimeter waveguide, a raised portion disposed laterally on both sides of the substrate at alternate quarter-wavelength sections adjacent one end of the substrate. The raised portions comprise a first layer of good electrically conductive material disposed on the substrate and a second layer of an insulating material formed atop the first layer. Alternatively, the exposed substrate sections can be gold plated. A preferred method comprises the steps of masking alternate quarter-wavelength sections of the exposed major surfaces adjacent one end of the substrate, depositing the first layer material on the unmasked quarter-wavelength sections and depositing the second layer material on the exposed major surfaces of the first layer material.

16 Claims, 10 Drawing Figures

MILLIMETER WAVEGUIDE SHORTS

BACKGROUND OF THE INVENTION

1. Field of the Invention

The present invention relates to millimeter waveguide shorts and methods for making such shorts and, more particularly, to a millimeter waveguide short comprising a metallic substrate, and alternate quarter-wavelength raised sections along a portion of the length of the substrate comprising a first layer of electrically conductive material deposited on the exposed major sides of the substrate and a second layer of an insulating material deposited on the outer surface of the first layer.

2. Description of the Prior Art

Waveguide shorts are used for various functions such as to tune various waveguide circuits. Such shorts have taken various forms, one of which was disclosed in U.S. Pat. No. 2,829,352 issued to S. R. Hennies et al on Apr. 1, 1958. The Hennies et al tunable waveguide short comprises a rectangular piston, a bearing member on each side of the piston for engaging the waveguide walls and a coil spring which engages the opposing waveguide walls.

Another waveguide short structure was disclosed in U.S. Pat. No. 3,049,684 issued to F. E. Vaccaro et al on Aug. 14, 1962 which comprises a choke mounted on the front end of a plunger which has slots for engaging cams on the waveguide walls to permit the short to be axially slideable in the waveguide. Still another short was disclosed in the article entitled "Sliding Short Eases Measurements" in *Microwaves,* Vol. 9, No. 12, December, 1970 at page 26 which comprises three cylindrical brass slugs separated by teflon slugs extending forward from a teflon block which is mounted forward of a block of lossy material.

The problem remaining in the prior art is to provide a waveguide short useable with millimeter waveguides which can be manufactured with more accurately controlled dimensional tolerances compared to the conventional machined structures found in the prior art.

SUMMARY OF THE INVENTION

The foregoing problem in the prior art has been solved in accordance with the present invention which relates to millimeter waveguide shorts and methods for making such shorts. More particularly, for use with rectangular waveguide, the present waveguide short comprises a thin rectangular substrate comprising both a metallic conducting material and a width which approximates the width of the waveguide section wherein the short is to be mounted, a first layer of good electrically conductive material disposed in alternate quarter-wavelength sections both normal to the longitudinal axis and on the exposed major surfaces of the substrate adjacent one end thereof, and a second layer of an insulating material disposed on the exposed major surface of the sections of first layer material on the substrate.

It is an aspect of the present invention to provide methods of manufacturing the present waveguide shorts using integrated circuit processing techniques which provide more accurately controlled dimensional tolerances compared with conventional machined shorts.

Other and further aspects of the present invention will become apparent during the course of the following description and by reference to the accompanying drawings.

BRIEF DESCRIPTION OF THE DRAWING

Referring now to the drawings, in which like numerals represent like parts in the several views.

DETAILED DESCRIPTION

Figure 1:
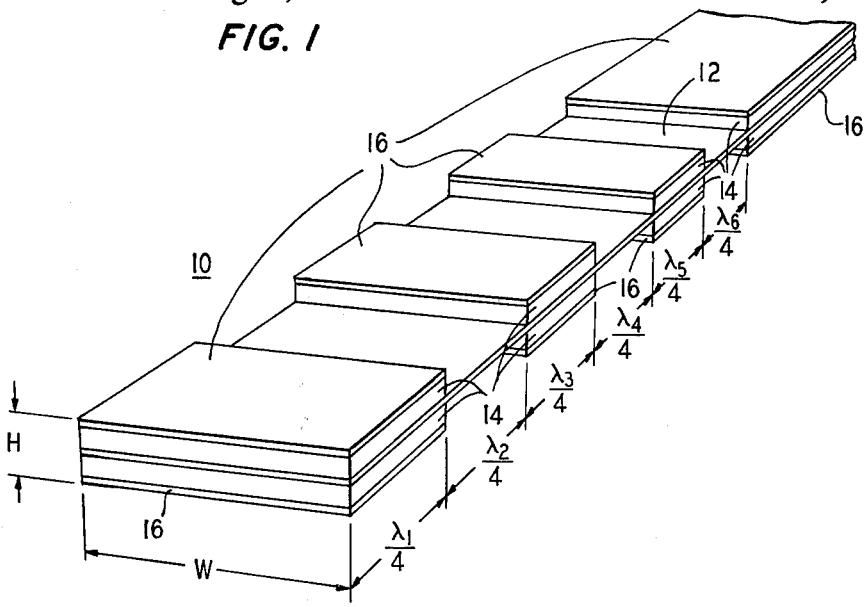
FIG. 1 is a view in perspective of the millimeter waveguide short according to the present invention.

FIG. 1 illustrates a millimeter waveguide short 10 formed in accordance with the present invention. Millimeter waveguide short 10 comprises a conductive metallic substrate 12 which can, for example, be a thin rectangular substrate 12 which can, for example, be a thin rectangular sheet of steel shimstock or foil having a width approximately equal to or less than the internal width of a rectangular waveguide wherein waveguide short 10 is to be mounted. Disposed laterally on both exposed major surface of substrate 12 at alternate one-quarter wavelength $$\left(\frac{\lambda}{4}\right)$$

sections designated $$\frac{\lambda_1}{4}, \frac{\lambda_3}{4} \text{ and } \frac{\lambda_5}{4}$$

along the length of the substrate adjacent one end thereof, are raised sections comprising a first layer 14 of a good electrically conductive material which can be electroplated onto the substrate material such as, for example, copper, silver, gold or nickel. Formed on the exposed major surface of each first layer section is a second layer 16 of an insulating material which can be an anodized metal such as, for example, anodized aluminum or tantalum. The width, W, and the height, H, of the formed waveguide short 10 substantially equals the width and height, respectively, of the internal cross-section of the rectangular waveguide (not shown) in which the short is to be slideably mounted.

It is to be understood hereinafter that the length of each of the odd-numbered quarter-wavelength sections $$\frac{\lambda_1}{4}, \frac{\lambda_3}{4}, \frac{\lambda_5}{4}, \text{etc.}$$

can be equal but that such length will differ slightly from the length of each of the even-numbered quarter-wavelength sections $$\frac{\lambda_2}{4}, \frac{\lambda_4}{4}, \frac{\lambda_6}{4}, \text{etc.}$$

The difference in length between the odd-numbered and even-numbered quarter-wavelength sections results because the effective dielectric constant of the material in each of the sections must be considered in determining the quarter-wavelength dimension. More particularly, in the area of the raised sections, which in FIG. 1 are quarter-wavelength sections $$\frac{\lambda_1}{4}, \frac{\lambda_3}{4}, \text{ and } \frac{\lambda_5}{4},$$

the effective dielectric constant must combine the dielectric constant of the insulating material and the material such as air found between the outer surface of the insulating material layer and the inside wall of the waveguide wherein the short is mounted if such latter area exists. In the non-raised sections, the dielectric constant will be that of the material, such as air, found between the substrate and the inside wall of the waveguide wherein the short is to be mounted. Additionally, it is to be understood hereinafter that wideband operation can be achieved by varying both the length of each even-numbered quarter-wavelength section and the length of each odd-numbered quarter-wavelength section so that each section covers a separate portion of the frequency band being supported by the waveguide section wherein the present short is to be mounted, as is well-known in the art.

One method of manufacturing the waveguide short shown in FIG. 1 in accordance with the present invention is shown in FIGS. 2–5 and comprises the following steps which are especially suitable for manufacturing waveguide shorts for reduced height waveguide such as, for example, code WR-8. In the preferred method of manufacturing, a conducting base substrate material 12 is cut into strips having a width substantially equal to or less than that of the millimeter waveguide section wherein the completed short is to be mounted. This conducting substrate material can comprise, for example, a commercially available shimstock such as the Starrett feeler stock with a thickness of, for example, 25–50 μm, and, for the WR-8 waveguide, may be cut with a width of approximately 2 mm.

Figure 2:
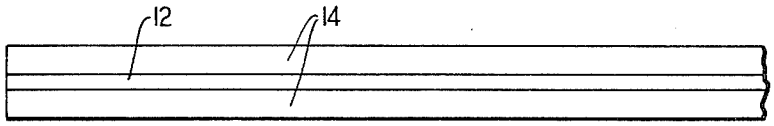
FIGS. 2–5 illustrate sequential steps of a method for manufacturing the millimeter waveguide short in accordance with the present invention.
Figure 3:
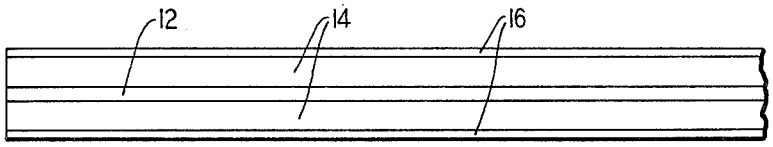

The base substrate material is next cleaned and a layer of good electrically conductive material 14, such as, for example, copper is electroplated on both opposing major exposed surfaces of the base substrate 12 as shown in FIG. 2. For the WR-8 waveguide short, the total thickness of the layer 14 on each side of substrate 12 may be 50–100 μm. A layer of anodizeable material 16 such as, for example, aluminum or tantalum is next evaporated on the exposed major surface of the layer 14 on each side of base substrate 12 as shown in FIG. 3. Layers 16, for the WR-8 waveguide, can have a thickness of 0.5–2.0 μm. Layers 16 are then anodized which will increase the layer 16 thickness by about 50 percent. An alternate technique is to sputter an insulating layer 16 on conductive layers 14 instead of evaporating anodizeable material thereon, which then permits elimination of the anodizing step.

Figure 4:
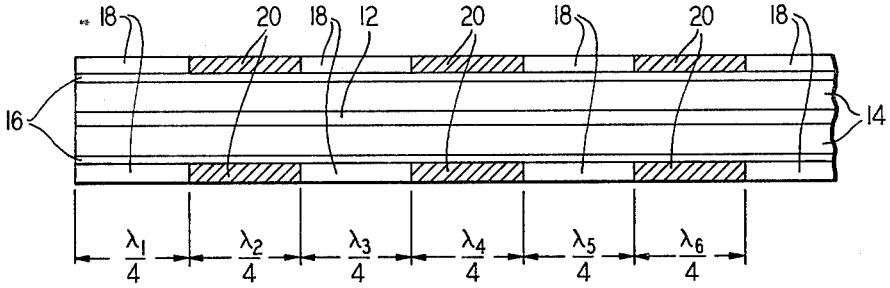
Figure 5:
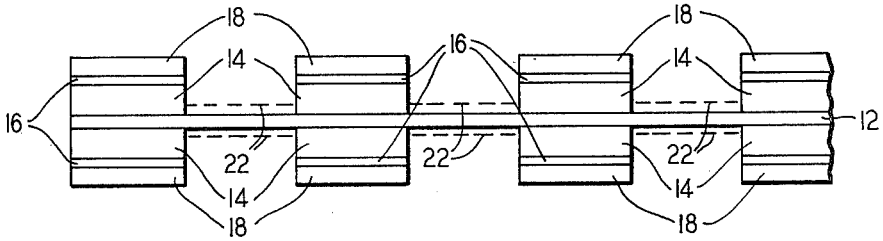

A layer of photoresist 18 is next applied to the exposed major surfaces of the layer of anodized material 16 on each side of substrate 12 as shown in FIG. 4. The resist 18 is selectively exposed to a suitable light source, as for example ultraviolet light, using an appropriate photomask (not shown) having a sequence of stripes such that alternate even numbered, quarter-wavelength sections of the resist adjacent one end of the substrate are exposed as shown in FIG. 4 by the hatched sections 20 of the resist layer 18. The exposed portions of the anodized layers 18 are etched off in a suitable compound which if it is assumed that the layers 18 are anodized aluminum layers such etching can be accomplished using, for example, KOH or NaOH. The exposed electrically conductive material layers 14, directly below where the exposed photoresist sections 20 were etched off, are next selectively etched off with a suitable compound which if layers 14 were copper could constitute, for example, Ferric chloride or Ammonium persulfate to produce the resultant structure shown in FIG. 5. The remaining unexposed photoresist 18 can be removed by, for example, plasma stripping to produce the waveguide short of FIG. 1.

The resulting waveguide short has all the required properties of a noncontacting waveguide short and is produced by plating, anodizing and photolithographic processing steps on a planar substrate. The exposed substrate 12 sections can alternatively be gold plated as shown by the dashed lines 22 in FIG. 5 to reduce the radio-frequency losses in these intermediate sections of the waveguide short.

Figure 7:
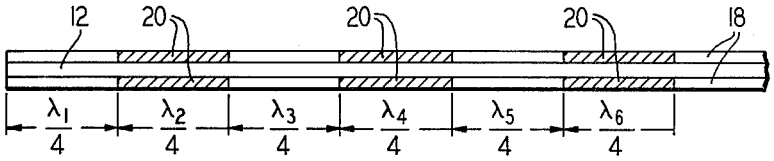
FIGS. 7 to 10 illustrate sequential steps of a preferred method of manufacturing the millmeter waveguide short of FIG. 1.

An alternative and preferred method of manufacturing the waveguide short of FIG. 1 is shown in FIGS. 7 to 10. A first step is to deposit a layer of photoresist, 18, such as, for example a negative photoresist, directly on both major exposed surfaces of substrate 12 as shown in FIG. 7 and then expose the appropriate even-numbered quarter-wavelength sections $$\frac{\lambda_2}{4}, \frac{\lambda_4}{4}, \frac{\lambda_6}{4}, \text{ etc.}$$

indicated by the hatched sections 20 in FIG. 7 to an appropriate light source through an appropriate photomask. When developing a layer of negative photoresist exposed as stated hereinbefore, only the hatched sections 20 in FIG. 7 will remain and the substrate will be exposed in the odd-numbered quarter-wavelength sections $$\frac{\lambda_1}{4}, \frac{\lambda_3}{4}, \frac{\lambda_5}{4}, \text{ etc.}$$

Figure 8:
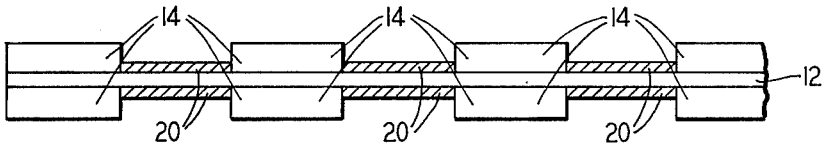
Figure 9:
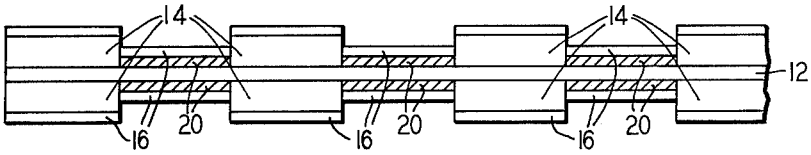
Figure 10:
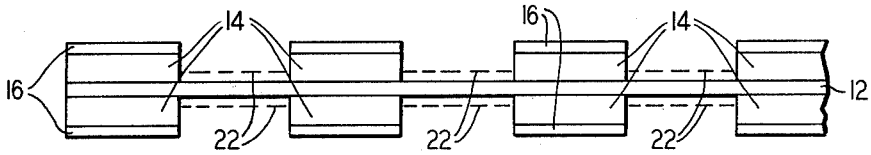

This is followed by depositing the layer of good electrically conductive material on the exposed sections of substrate 12 as shown in FIG. 8. A layer of insulating material 16 is next deposited and will cover both the exposed surface of layers 14 and photoresist layers 20. To remove the photoresist layers 20 and the insulating layer 16 thereon, the short is next immersed in a photoresist remover, as is well known in the art, to produce the waveguide short as shown in FIG. 10. As was stated hereinbefore the exposed substrate, where exposed photoresist layer 20 had existed, can be gold plated to reduce radio frequency losses as shown with dashed lines 22 in FIG. 10.

The present waveguide short 10 can also be made using an interstitial compound to increase the hardness of the substrate 12. Interstitial compounds are well known in the art, and in this regard see, for example, the article "Interstitial Compounds" by L. H. Bennett et al in *Physics Today,* September, 1977 at pp. 34–41. With such compounds, a substrate 12 thickness of, for example, 10–20 μm may be sufficient to support the plated sections for use in certain waveguide sections. For the present short, the impedance of the plated sections advantageously should be, although not absolutely necessary, as small as possible. This can be achieved by maintaining the air gap between the plated portions of the short and the adjacent waveguide walls as small as possible and by using a dielectric layer 16 having a high dielectric constant such as, for example, tantalumoxide. Another useful dielectric which can be sputtered is titaniumoxyde with a dielectric constant of approximately 100. The impedance of the unplated sections of waveguide short 10 should preferably be as large as possible and, therefore, the substrate 12 should be as thin as possible. This impedance can be further increased by selectively etching a honeycomb structure or perforations into the substrate after the short has been constructed provided the remaining honeycombed substrate will support the plated quarter-wavelength sections. This honeycombing can be accomplished using conventional masking and etching techniques or by selective ion milling.

Figure 6:
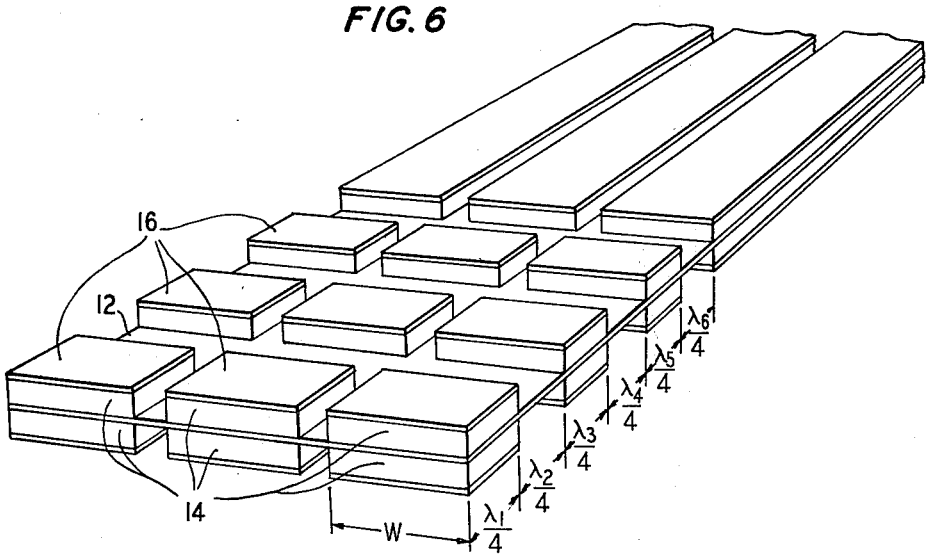
FIG. 6 illustrates a view in perspective of a photolithographic array of electroformed waveguide shorts prior to separation into individual waveguide shorts as shown in FIG. 1.

The present waveguide shorts can also be mass produced in array 30 form as shown in FIG. 6. There a plurality of waveguide shorts are formed on uncut substrate material 12 and either one of the two hereinbefore methods for forming the single waveguide short 10 of FIG. 1 can be used to make the array 30 of electroformed shorts shown in FIG. 6. The resultant array 30 is then appropriately machined or cut to produce the individual waveguide shorts of FIG. 1.

It is to be understood that the above-described embodiments are simply illustrative of the principles of the invention. Various other modifications and changes may be made by those skilled in the art which will embody the principles of the invention and fall within the spirit and scope thereof. For example, the present waveguide short could similarly be formed for circular waveguide using a circular rod as the base substrate 12, or in FIG. 6 the raised portions with layers 14 and 16 can be disposed completely across substrate 12 in bands rather than the separate sections as shown.

We claim:

1. A waveguide short (10) capable of being slideably mounted within a waveguide section
CHARACTERIZED IN THAT
the waveguide short comprises
a substrate (12) comprising an electrically conductive material and a longitudinal axis;
a first layer (14) of a good electrically conductive material disposed in alternate quarter-wavelength sections both normal to the longitudinal axis and on the exposed major surfaces of the substrate adjacent one end thereof, the length of the quarter-wavelength sections being determined from the frequency bands to be supported by the waveguide section and the effective dielectric constant of the material in each quarter-wavelength section; and
a second layer of an insulating material disposed on the exposed major surface of each of the sections of good electrically conductive material.

2. The waveguide short in accordance with claim 1
CHARACTERIZED IN THAT
the insulating material of said second layer is an anodized metal.

3. The waveguide short in accordance with claim 1
CHARACTERIZED IN THAT
the substrate (12) further comprises a thin rectangular sheet of said electrically conductive material having a width which approximates the width of a rectangular waveguide section wherein the waveguide short is to be slideably mounted.

4. The waveguide short in accordance with claims 1, 2 or 3
CHARACTERIZED IN THAT
the waveguide short further comprises
a third layer (22) of a material capable of reducing radio-frequency losses disposed on the exposed major surfaces of the substrate in the alternate quarter wavelength sections not supporting the first layer of electrically conductive material.

5. The waveguide short in accordance with claim 1, 2, or 3
CHARACTERIZED IN THAT
each of the first layer quarter-wavelength sections comprises a length which is slightly different than the length of any of the other first layer quarter-wavelength sections in order to tune each first layer quarter-wavelength section to a separate portion of the frequency band to be supported by the waveguide section; and
each of the alternate quarter-wavelength sections not supporting the first layer comprises a length which is slightly different than the length of any of the other alternate quarter-wavelength sections not supporting the first layer in order to tune each of said alternate quarter-wavelength sections not supporting the first layer to a separate portion of the frequency band to be supported by the waveguide section.

6. The waveguide short in accordance with claim 1
CHARACTERIZED IN THAT
the substrate comprises perforations in the quarter-wavelength sections not supporting the first layer of good electrically conducting material.

7. A method of forming a waveguide short capable of being slideably mounted within a waveguide section
CHARACTERIZED IN THAT
the method comprising the steps of:
(a) depositing a first layer (14) of a good electrically conductive material on the exposed major surfaces of a substrate (12), the substrate comprising an electrically conductive material and a longitudinal axis;
(b) depositing a second layer (16) of an insulating material on the exposed major surfaces of said first layer of good electrically conductive material;
(c) depositing a third layer (18) of a photoresist on the exposed major surfaces of said second layer of insulating material;
(d) exposing alternate quarter-wavelength sections of the photoresist which are both normal to the longitudinal axis of the substrate and adjacent one end thereof to an appropriate light source, the length of said quarter-wavelength sections being determined from the frequency band to be supported by the waveguide section and the effective dielectric constant of the material in each quarter-wavelength section;
(e) etching the second layer and the first layer off to expose the substrate in the area of the exposed photoresist; and
(f) removing the photoresist from the second layer of insulating material in the unexposed areas.

8. The method in accordance with claim 7
CHARACTERIZED IN THAT
in performing step (b), performing the steps of:

(1) depositing a second layer of an anodizable metal on the first layer of a good electrically conductive material; and (2) anodizing said second layer of an anodizable metal.

9. The method in accordance with claim 7 or 8
CHARACTERIZED IN THAT
the method comprises the further step of:

(g) after step (f), depositing a fourth layer of a material capable of reducing radio-frequency losses on the exposed major surfaces of the substrate in the alternate quarter-wavelength bands not supporting the first layer of good electrically conductive metal.

10. The method in accordance with claim 7 wherein the waveguide section is of a rectangular cross-section and it is desired to concurrently form a plurality of waveguide shorts
CHARACTERIZED IN THAT
in performing step (a), using a substrate comprising a thin sheet of an electrically conductive material; and
the method comprises the further step of:

(g) separating the resulting structure of step (f) along lines which both are normal to said alternate quarter-wavelength bands of deposited layers of good electrically conductive metal and insulating material and have a width which approximates the width of the waveguide section wherein each waveguide short is to be slideably mounted.

11. The method in accordance with claim 7
CHARACTERIZED IN THAT
in performing step (d), exposing the photoresist in a manner that each of the odd-numbered quarter-wavelength sections and each of the even-quarter-wavelength sections have a slightly different length than the length of any of the other odd-numbered quarter-wavelength sections and even-numbered quarter-wavelength sections, respectively, so that each of the associated odd-numbered and even-numbered quarter-wavelength sections are tuned to a different portion of the frequency band to be supported by the waveguide section wherein the waveguide short is to be slideably mounted.

12. A method of forming a waveguide short capable of being slideably mounted within a waveguide section
CHARACTERIZED IN THAT
the method comprises the steps of:

(a) depositing a first layer of a photoresist on the exposed major surfaces of a substrate (12) comprising an electrically conductive material and a longitudinal axis;

(b) exposing quarter-wavelength sections of the first layer adjacent one end of and normal to the longitudinal axis of the substrate, the length of said quarter-wavelength sections along said longitudinal axis being determined from the frequency band to be supported by the waveguide section wherein the waveguide short is to be mounted and the effective dielectric constant of the material in each quarter-wavelength section;

(c) developing said exposed photoresist to expose the substrate in alternate ones of the quarter-wavelength sections;

(d) depositing a second layer (14) of a good electrically conductive material on the exposed major surfaces of the substrate;

(e) depositing a third layer (16) of an insulating material on the exposed major surfaces of the second layer; and (f) removing the photoresist and any deposit thereon obtained from step (e) to expose the substrate in the alternate quarter-wavelength sections not supporting a second layer of good electrically conductive material.

13. The method in accordance with claim 12
CHARACTERIZED IN THAT
in performing step (e), performing the steps of:

(1) depositing a third layer of anodizable metal on said exposed major surfaces of said second layer; and (2) anodizing said third layer of an anodizable metal.

14. The method according to claim 12 or 13
CHARACTERIZED IN THAT
the method comprises the further steps of:

(g) after step (f), depositing a layer of a material capable of reducing radio-frequency losses on the major surfaces of the substrate not supporting the second layer of good electrically conductive material.

15. The method according to claim 12 wherein the waveguide is of a rectangular cross-section and it is desired to concurrently form a plurality of waveguide shorts
CHARACTERIZED IN THAT
in performing step (a), using a substrate comprising a thin sheet of an electrically conductive material; and
the method comprises the further step of:

(g) separating the resultant structure of step (f) along lines which both are normal to said quarter-wavelength sections and have a distance therebetween which approximates the width of the waveguide section wherein each waveguide short is to be slideably mounted.

16. The method in accordance with claim 12
CHARACTERIZED IN THAT
in performing step (b), exposing the photoresist in a manner that each of the odd-numbered quarter-wavelength sections and each of the even-quarter-wavelength sections have a slightly different length than any of the other odd-numbered quarter-wavelength sections and even-numbered quarter-wavelength sections, respectively, so that each of the associated odd-numbered and even-numbered quarter-wavelength sections are tuned to a different portion of the frequency band to be supported by the waveguide section wherein the waveguide short is to be slideably mounted.

* * * * *

UNITED STATES PATENT AND TRADEMARK OFFICE

CERTIFICATE OF CORRECTION

PATENT NO. : 4,216,450

DATED : August 5, 1980

INVENTOR(S) : Richard A. Linke and Martin V. Schneider

It is certified that error appears in the above-identified patent and that said Letters Patent are hereby corrected as shown below:

Column 2, line 24, delete entire line. Column 2, line 25, delete "thin".

Signed and Sealed this

*Third* Day of *February 1981*

[SEAL]

*Attest:*

RENE D. TEGTMEYER

*Attesting Officer*

*Acting Commissioner of Patents and Trademarks*